US006425844B1

(12) United States Patent
Azar

(10) Patent No.: US 6,425,844 B1
(45) Date of Patent: Jul. 30, 2002

(54) KNEE EXERCISING DEVICE

(76) Inventor: Tony Azar, 355 North Service Road, East Windsor, Ontario (CA), N8W 5R7

( * ) Notice: Subject to any disclaimer, the term of this patent is extended or adjusted under 35 U.S.C. 154(b) by 0 days.

(21) Appl. No.: 09/513,544

(22) Filed: Feb. 25, 2000

(30) Foreign Application Priority Data

Dec. 22, 1999 (CA) ..... 2293035

(51) Int. Cl.[7] ..... A63B 21/055; A63B 23/04

(52) U.S. Cl. ..... 482/79; 482/125; 482/132; 482/123

(58) Field of Search ..... 482/51, 70, 79, 482/80, 91, 105, 132, 145, 125, 123; 280/11.19, 11.209, 11.25; 601/34

(56) References Cited

U.S. PATENT DOCUMENTS

| | | | | | |
|---|---|---|---|---|---|
| 1,138,263 | A | * | 5/1915 | Tutt | 280/11.19 |
| 1,179,496 | A | * | 4/1916 | Bartholomew | 280/11.19 |
| 1,332,702 | A | * | 3/1920 | Wisniewski | 280/11.19 |
| 1,734,238 | A | * | 11/1929 | Sweeney | 482/123 |
| 1,751,942 | A | * | 3/1930 | Nanz | 280/11.25 |
| 2,250,493 | A | * | 7/1941 | Milne | 482/79 |
| 2,825,575 | A | * | 3/1958 | Mickels | 280/205 |
| 3,476,399 | A | * | 11/1969 | Finn | 280/11.25 |
| 3,524,642 | A | * | 8/1970 | Aguilar | 482/51 |
| 3,672,670 | A | * | 6/1972 | Burzenski | 482/80 |
| 3,684,305 | A | * | 8/1972 | McDonald et al. | 280/11.19 |
| 3,802,700 | A | * | 4/1974 | Mayo | 482/79 |
| 4,304,417 | A | * | 12/1981 | Hsieh | 280/11.19 |
| 4,463,947 | A | * | 8/1984 | Kloenne | 482/139 |
| 4,647,035 | A | * | 3/1987 | Yellen | 482/115 |
| 4,709,937 | A | * | 12/1987 | Lin et al. | 280/11.209 |
| 5,690,594 | A | * | 11/1997 | Mankovitz | 482/121 |

FOREIGN PATENT DOCUMENTS

| | | | | |
|---|---|---|---|---|
| DK | 71384 | * | 8/1950 | 482/130 |
| FR | 1209122 | * | 2/1960 | 482/132 |

* cited by examiner

*Primary Examiner*—Jerome W. Donnelly
*Assistant Examiner*—Victor Hwang
(74) *Attorney, Agent, or Firm*—Anthony J. Casella; Gerald E. Hespos

(57) ABSTRACT

There is described a knee exercising device comprising a foot support and a pair of wheels attached to the heel of the foot support, wherein the wheels allow the wearer to exercise their knee while sitting or lying down simply by raising their foot and rolling it forward and backward. There is further provided a detachable cord means which enables a user to use their arms to aid the motion of the knee, particularly when the muscle strength of a leg is insufficient for this purpose.

3 Claims, 3 Drawing Sheets

KNEE EXERCISING DEVICE

FIELD OF THE INVENTION

The present invention relates to knee exercising devices.

BACKGROUND OF THE INVENTION

As those with knee problems will be aware, it is very difficult to exercise the joint of the knee without standing on one's feet and applying undue pressure on the knee. Furthermore, most exercises for the knee require voluntary movement which may be difficult when rehabilitating from severe knee injuries, or from total or partial knee replacement surgery.

There therefore exists a need for a knee exercising device that allows a user to exercise the knee while sitting and without significant muscular exertion that could prove counterproductive to rehabilitation.

SUMMARY OF THE INVENTION

It is an object of the present invention to provide a knee exercising device that is an improvement over the prior art.

It is a further object of the present invention to provide a means to exercise the knee while sitting or lying on one's back.

According to the present invention there is provided a knee exercising device comprising, a support portion securable to the ankle of a person, at least one wheel securable to said support portion at the lower rear comer thereof, to permit the foot of a wearer of the device to pivot relative to a surface on which said at least one wheel is placed.

The present invention has many advantages. In particular, it provides a device that allows the user to exercise the knee while sitting or lying down. It also provides a device for exercising the knee that requires limited applied force from the user. It further provides a device for exercising the knee where the applied force by the leg is further reduced through a cord means manipulable by the user's hands or arms.

Other advantages, objects and features of the present invention will be readily apparent to those skilled in the art.

BRIEF DESCRIPTION OF THE DRAWINGS

In drawings that illustrate the present invention by way of example.

DETAILED DESCRIPTION OF THE DRAWINGS

Figure 1:
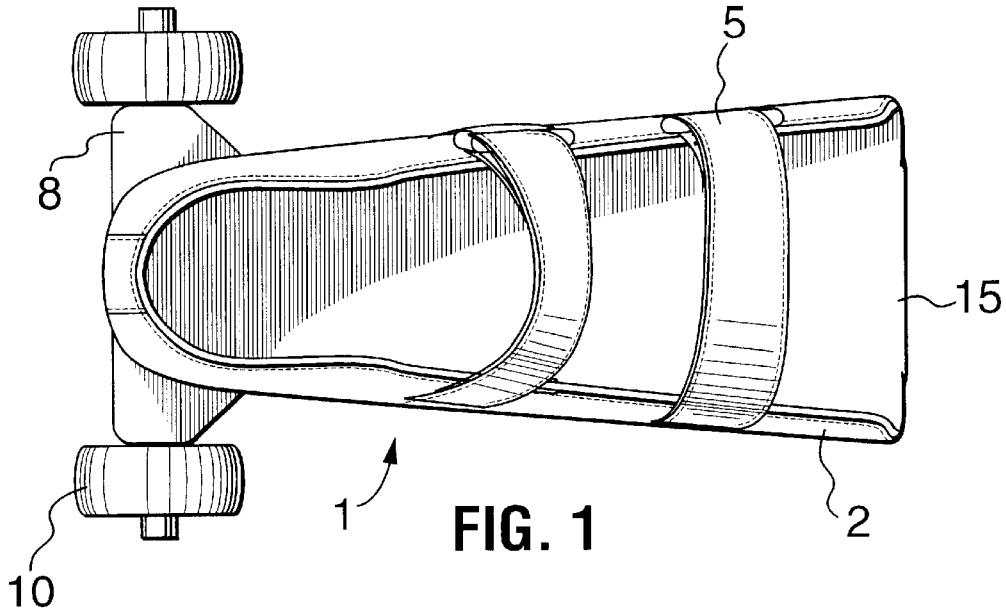
FIG. 1 is a top view of the knee exercising device.

Referring to FIG. 1 of the drawings, a preferred embodiment of knee exercising apparatus 1 comprises of a foot support 2 and a pair of wheels 10 attached to wheel support 8.

Foot support 2 is contoured to the shape of the foot and fits over the foot like a shoe. In a preferred embodiment, the foot support 2 has an open toe 15 that allows foot support 2 to accommodate feet of many shapes and sizes while maintaining the overall structure of the foot.

In a preferred embodiment, foot support 2 is composed of a resilient, durable material that provides sufficient support for the foot when the foot is pivoted and pressure is placed on wheels 10.

Figure 6:
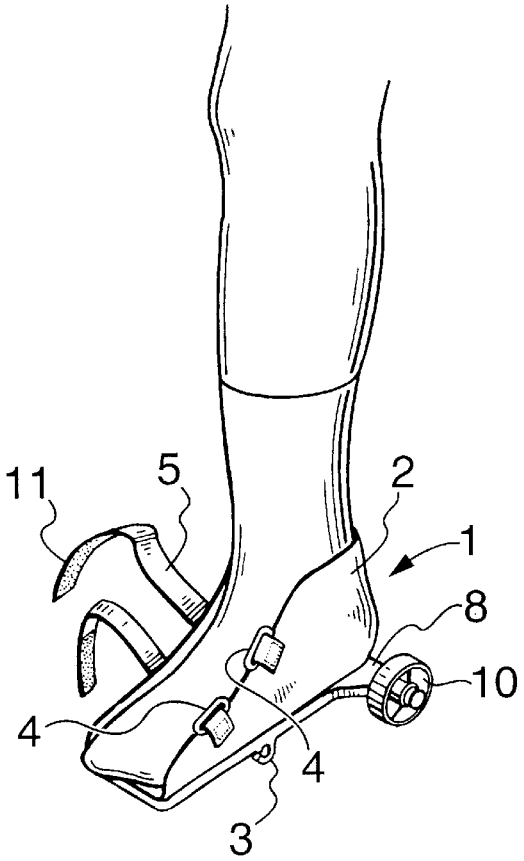
FIG. 6 is a left front perspective view of the knee exercising device as viewed on the foot of a user.

Foot support 2 is secured to the foot and adjusted to the size of the foot by a fastening means. The knee exercising apparatus 1 has at least one fastening means located on the ankle portion of foot support 2 and at least one fastening means located on the arch portion of foot support 2, whereby the fastening means ensures that foot support 2 is securely in place over the ankle and foot. A preferred embodiment of the fastening means is best seen in FIG. 6. A strap 5 is placed through ring 4 and secured in place using VELCRO™ strip 11. One skilled in the art will appreciate that the fastening means can also take other forms such as a lace or buckled securing means. One skilled in the art will also appreciate that foot support 2 can have any number of attachment points located at various positions along the foot support 2 without deviating from the device as claimed.

A pair of coaxial wheels 10 are located on opposite sides of foot support 2 and are disposed about the heel region of foot support 2. Wheels 10 are joined by axle 13 and are supported by wheel support 8, as can best be seen by referring to FIG. 2. Wheel support 8 provides a means to secure axle 13 in place while allowing axle 13 to rotate freely. Wheels 10 and axle 13 may be removable from wheel support 8 to provide for replacement thereof.

Figure 2:
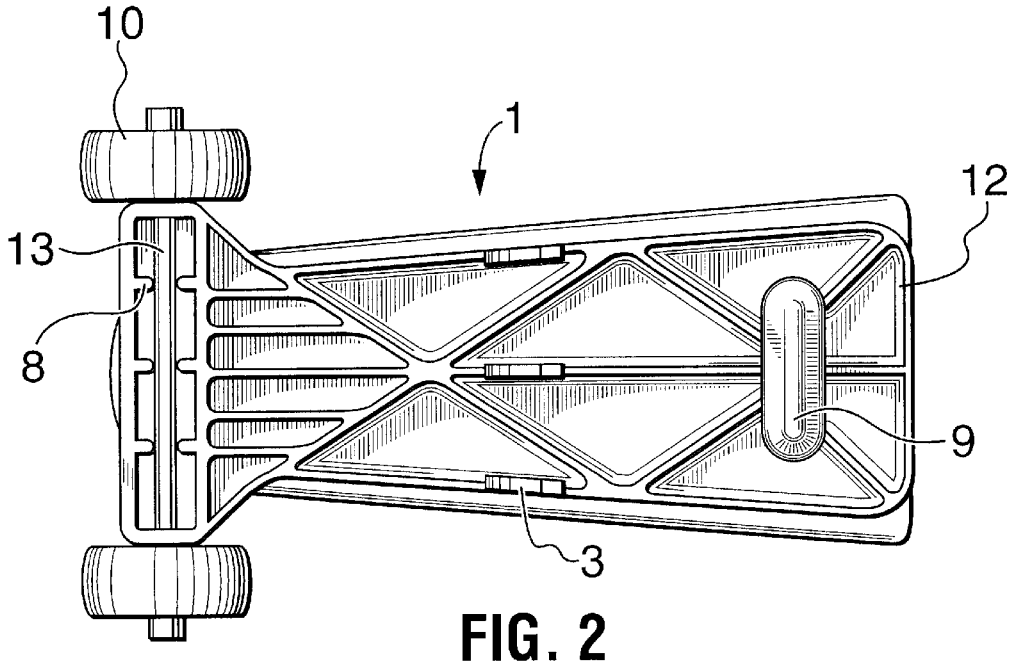
FIG. 2 is a bottom view of the knee exercising device.
Figure 3:
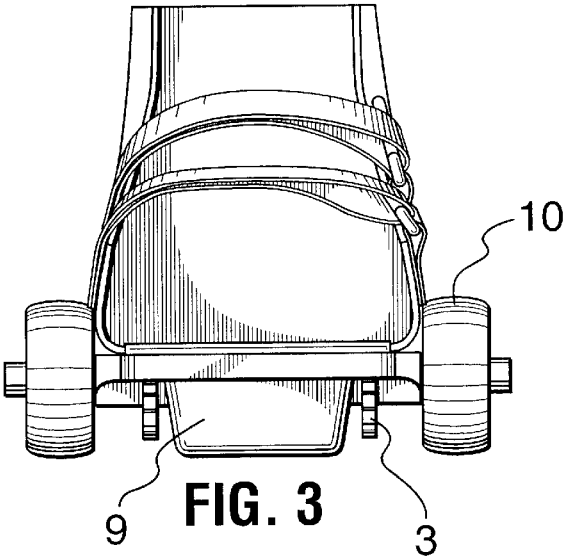
FIG. 3 is a front view of the knee exercising device.
Figure 4:
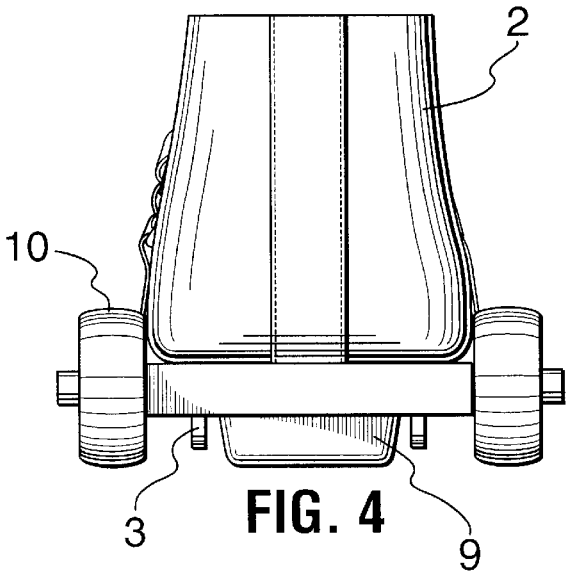
FIG. 4 is a back view of the knee exercising device.

Wheel support 8 is further connected to sole 12, as is best seen in FIG. 2. Sole 12 is composed of a rigid material and is designed to support the weight of a user. In one embodiment of the invention, sole 12 and wheel support 8 are composed of the same piece of material, one example of which is a rigid moulded plastic.

Sole 12 further is attached to toe support 9. Toe support 9 is disposed under and towards the front portion of sole 12 and is approximately the same height as the radius of wheel 12, allowing a user to stand while maintaining the foot in a level position. In a preferred embodiment toe support 9 has a non-slip tread on it lower surface to permit limited, but fairly safe mobility while wearing knee exercising apparatus 1.

Figure 7:
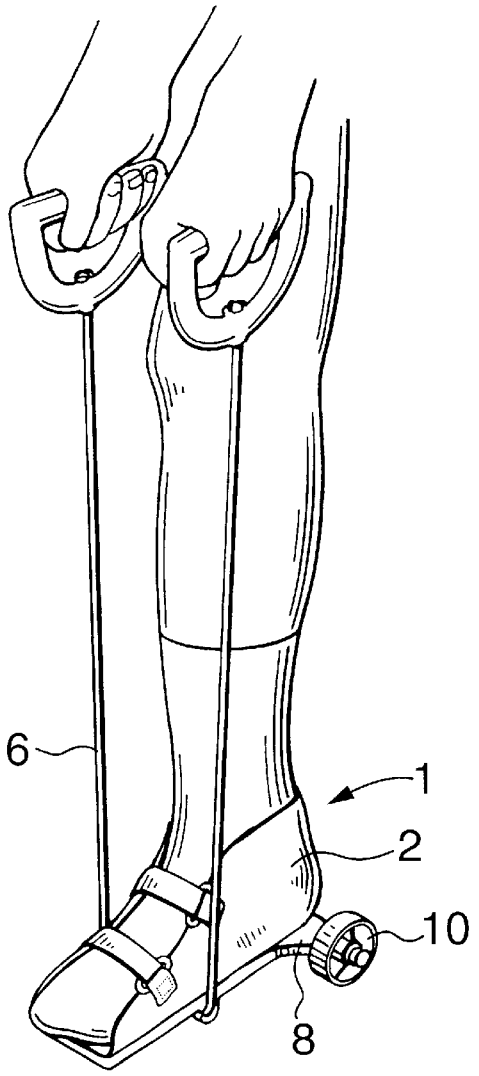
FIG. 7 is a left front perspective view of the knee exercising device as viewed on the foot of a user and includes a cord means.

Knee exercising apparatus 1 is further provided with cord means 6, as can best be seen in FIG. 7. Cord means 6 allows a user to manipulate knee exercising apparatus 1 with his or her hands, allowing the user to reduce the tension on the knee and facilitating recovery. Cord means 6 may be made of any resilient flexible material. In one embodiment of the invention, cord means 6 is provided with handles to aid the user's grip.

Figure 5:
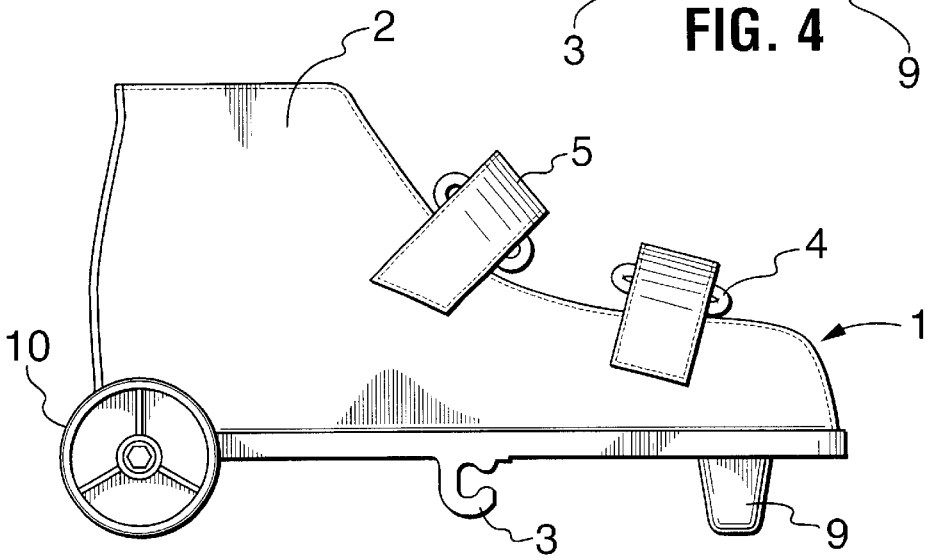
FIG. 5 is a side view of the knee exercising device.

Cord means 6 is attached to knee exercising apparatus 1 through hook means 3. Hook means 3 can best be seen by referring to FIGS. 2 and 5. Hook means 3 is attached to the lower portion of sole 12 and is shaped to provide a secure fit for cord means 6, yet facilitate the attachment and removal of cord means 6. The height of hook means 3 is such that the bottom of hook means 3 does not touch the ground when toe support 9 and wheel 10 are on the ground.

In operating knee exercise assembly 1, if the user pushes forward from their heel, the wheels located in the heel area of foot support 2 will roll, permitting the person's foot to move forward with little effort or friction and in the process extend the wearer's leg so that their knee is moved from a bent to an extended position. If the user pulls back with their heel, the wheels located in the heel area of foot support 2 will roll, permitting the person's foot to move backwards with little friction, and in the process bend the wearer's leg so that their knee is moved from an extended to a bent position. This movement can also be aided by attaching cord means 6. The user can then pull on cord means 6 to bend the knee when the muscle strength in the leg is insufficient for this purpose. In this way, the user can continue rolling their foot back and forth for whatever period of time and at whatever angle they require to exercise their knee. It will be obvious to one skilled in the art that this type of device will be beneficial to those who have undergone knee surgery.

Numerous modifications, variations and adaptations may be made to the particular embodiments of the invention described above without departing from the scope of the invention, as defined in the claims.

The embodiments of the present invention in which an exclusive property or privilege is claimed are defined as follows:

1. A knee exercising device, comprising:

an elongated support portion having an upper surface for supporting a foot of a person and an oppositely facing lower surface, said elongated support portion being securable to the ankle of the person, said support portion having a rear end and a forward end, with the ankle of the person being disposed adjacent said rear end and the toes of the person being disposed adjacent said forward end;

at least one wheel secured to said support portion at the rear end thereof and projecting below the lower surface of the support portion to permit the foot of a wearer of the device to pivot relative to a surface on which said at least one wheel is placed, the support portion being free of wheels at locations forward of the at least one wheel that is secured to the rear end of the support portion;

a toe support depending from the lower surface of the support portion adjacent the forward end thereof, the lower surface of the support portion being free of non-rotatable supports at locations rearward of the toe support, and wherein said at least one wheel defines a radius, the toe support projecting from said lower surface of said support portion by a distance substantially equal to the radius of said at least one wheel, such that the support portion is supportable simultaneously by the at least one wheel and the toe support; and a resilient cord means and an attachment means, wherein said attachment means selectively secures said resilient cord means to said support portion, and wherein said resilient cord means aids in exercising the knee when tension is applied to said resilient cord means.

2. A knee exercising device as defined in claim 1, wherein said at least one wheel comprises two wheels secured to the lower surface at the rear end of the support portion.

3. A knee exercising device as defined in claim 2, wherein the wheels are located on adjacent sides of the rear end of the support portion.

* * * * *